United States Patent [19]

Ito et al.

[11] Patent Number: 4,502,031

[45] Date of Patent: Feb. 26, 1985

[54] ELECTROMAGNET AND METHOD OF PRODUCING THE SAME

[75] Inventors: Haruhiko Ito; Mineo Sano, both of Aichi, Japan

[73] Assignee: Mitsubishi Denki Kabushiki Kaisha, Tokyo, Japan

[21] Appl. No.: 422,508

[22] Filed: Sep. 23, 1982

[30] Foreign Application Priority Data

Sep. 24, 1981 [JP] Japan ..... 56-141515[U]

[51] Int. Cl.[3] ..... H01F 7/08

[52] U.S. Cl. ..... 335/277; 335/257

[58] Field of Search ..... 335/251, 255, 257, 258, 335/261, 277

[56] References Cited

U.S. PATENT DOCUMENTS

| | | | |
|---|---|---|---|
| 3,400,351 | 9/1968 | Flentge | 335/277 X |
| 3,479,627 | 11/1969 | Underwood | 335/277 X |
| 3,629,755 | 12/1971 | Schaller | 335/277 X |

*Primary Examiner*—George Harris

*Attorney, Agent, or Firm*—Sughrue, Mion, Zinn, Macpeak and Seas

[57] ABSTRACT

An electromagnet for use in a contactor, for example, is provided with non-magnetic thin plates fixed to either or both of the fixed and moving-iron core contacting surfaces. The plates provide good abrasion and shock resistance and prevent attraction between the fixed and moving cores due to magnetic remanence.

9 Claims, 6 Drawing Figures

ELECTROMAGNET AND METHOD OF PRODUCING THE SAME

BACKGROUND OF THE INVENTION

The present invention relates to an electromagnet, and more particularly to an electromagnet and a method for producing the same wherein the electromagnet has an attractive force generated by magnetic flux due to a d.c. current or rectified a.c. current.

It is well known that electromagnetic contactors are broadly employed for opening and closing operations of various circuits. That is, a movable contact is maintained contacted to a fixed contact connected to a main circuit by passing a current through the electromagnet so that the circuit is closed. On the other hand, the circuit is opened by stopping the current to the electromagnet. An outline of this type of electromagnet contactor will now be described with reference to the accompanying drawings.

In FIGS. 1 and 2, breaks are provided at portions of a current passage 10*a*, 10*b* and 10*c* supplying a three-phase a.c. source to the main circuit. Movable-contactors 16 which are pushed and held through a compression spring 18 by a cross bar 14 are movable disposed upwardly and opposed to the fixed-contactors 12. A return spring (not shown) is provided between the cross bar 14 and the fixed-contactor part so as to separate the movable-contactors 16 upwardly from the fixed-contactor 12. Also, the cross bar 14 is lowered against the return coil spring by the electromagnet 20 provided below. The electromagnet 20 is composed of an "I" shaped movable-iron core 24 having a contact surface 22 fixed with degree of freedom to the lower end of the cross bar 14 and an "U" shaped fixed-iron core 28 having a contact surface 26 confronting the contact surface 22. An operational coil 32 is wound around one of magnetic legs 30 of the fixed-iron core 28.

A driving circuit for exciting the operational coil circuit is shown in FIG. 3. An a.c. source is connected through a starting switch 35 and an exchange circuit 36 to a rectifier circuit 38 whose outputs are applied to the operational coil 32. The exchange circuit 36 is composed of a normally-closed switch 40, resistor 42 and a condenser 44 for dividing the voltage. The latter two elements are in parallel with the normally-closed switch 40. Further, the switch 40 is opened when the movable-iron core 24 is attracted to the fixed-iron core 28, i.e., when the main circuit is switched on. In addition, reference numeral 46 designates a varistor for constant voltage. In the formation of a closed loop to the main circuit, the a.c. source 34 is coupled through the switch 40 to the rectifier circuit 38 by closing the starting switch 35, so that the rectified output excites the operational coil 32. Therefore, the movable-iron core 24 is attracted to the fixed-iron core 26, that is, the cross bar 14 descends against the return coil spring so that the movable-contactor 16 is contacted to the fixed-contactor 12. As a result, current flow to the main circuit is initiated.

After the formation of a closed loop to the main circuit is completed, the normally-closed switch 40 is opened so that the a.c. source 34 supplies a smaller exciting current to the operational coil 32 through the resistor 42 and condenser 44 than that at the time of loop closure. That is, the attraction of the movable-iron core 24 toward the fixed-iron core is maintained by a smaller exciting current.

By the way, in the above electromagnet, the moving-iron core 24 and the fixed-iron core 28 are attracted to each other and contacted by switching on a current, and are detached from each other by switching off this current. However, many on-off operations cause the generation of (magnetic) remanence in the core so that it is impossible to detach the moving-iron core 24 from the fixed-iron core 28 by turning off the current. Also, the contacting surfaces of both the moving-iron core and the fixed-iron core suffer a shock when the surfaces come together by turning on the current, resulting in an abrasion and deformation of the iron core. Therefore, it is required to impart abrasion resistance and shock strength to the iron cores.

Various attempts for improving the conventional defects have been proposed (see, for example, Japanese Patent publication No. 20096/65 and Japanese Utility Model publication No. 19269/71).

Also, it has been proposed that a non-magnetic layer having a thickness of 2–3 μm be formed on the contacting surfaces of at least one between the moving-iron core and the fixed-iron core by hard chrome plating or the like under conditions such as those of the plating bath composition, temperature and current density below.

TABLE

| | |
|---|---|
| Chromic acid anhydride | 150 g/l |
| Sulfuric acid | 1.8–1.5 g/l |
| Specific gravity | 13.5 |
| Temperature | 45–55° C. |
| Current density | 10–80 A/cm$^2$ |

In this case, it is very difficult to uniformly form a non-magnetic layer having a desired thickness of 0.08–0.2 mm. Furthermore, the magnetic characteristics of the iron cores are unstable and excellent abrasion resistance and shock strength cannot be obtained from the conventional chrome plating layer.

SUMMARY OF THE INVENTION

The present invention has been provided to eliminate the foregoing drawbacks; and an object thereof is to provide an electromagnet including a non-magnetic plate having a desired thickness, a smooth surface, excellent mangetic characteristics and good shock strength formed on the surfaces of at least one of the moving-iron core and the fixed-iron core.

In order to achieve the above object, the present invention is characterized by an electromagnet in which an attractive force is generated by magnetic flux due to a d.c. current or rectified a.c. current, wherein thin non-magnetic plates are thermally melted and fixed through a melt type adhesive formed on one of the contacting electrode surfaces of the moving-iron core or the fixed-iron core, so that mutual attraction by magnetic remanence between the moving-iron core and the fixed-iron core is prevented.

DETAILED DESCRIPTION OF THE PREFERRED EMBODIMENTS

Figure 1:
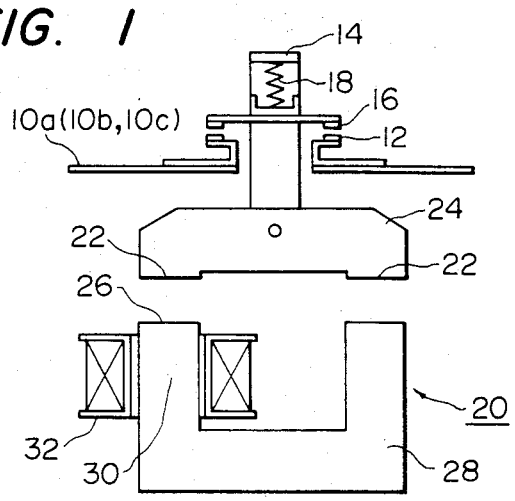
FIG. 1 is an outline of an assembly using an electromagnetic contactor.
Figure 2:
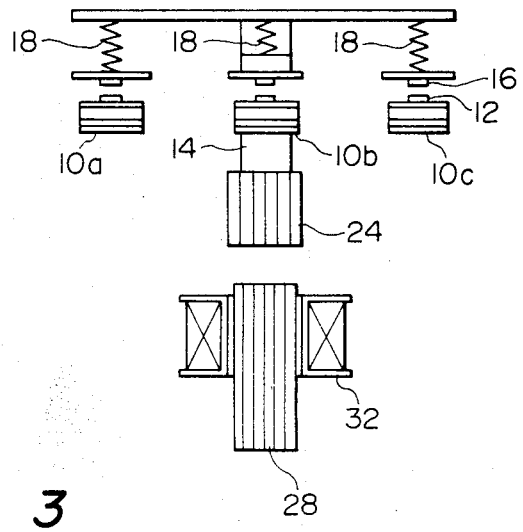
FIG. 2 is a side view of FIG. 1.
Figure 3:
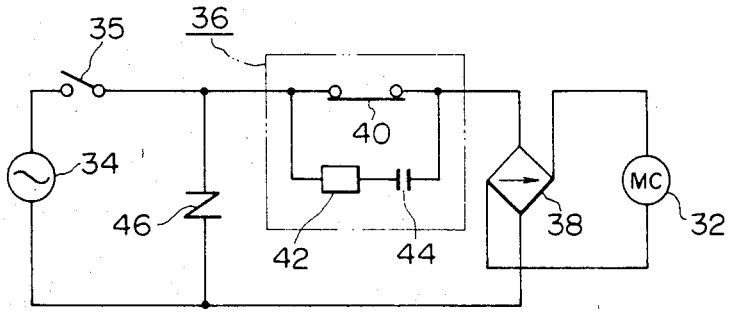
FIG. 3 is a circuit diagram showing the driving circuit of an operational coil.
Figure 4:
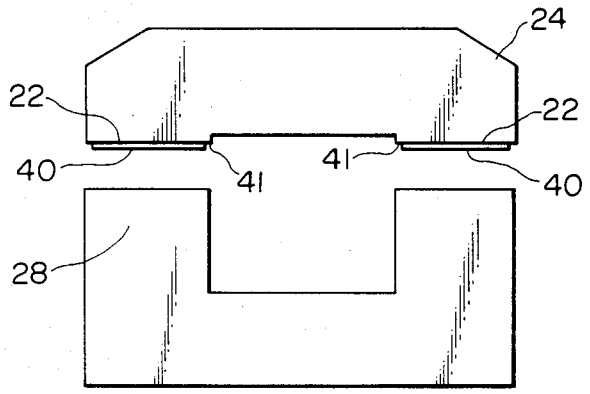
FIG. 4 is a front view showing a preferred embodiment of the present invention.
Figure 5:
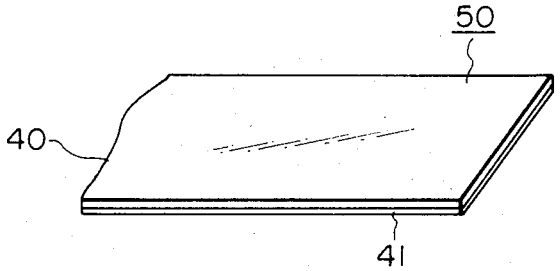
FIG. 5 is a perspective view showing a thin non-magnetic plate with a melt-type adhesive formed thereon.
Figure 6:
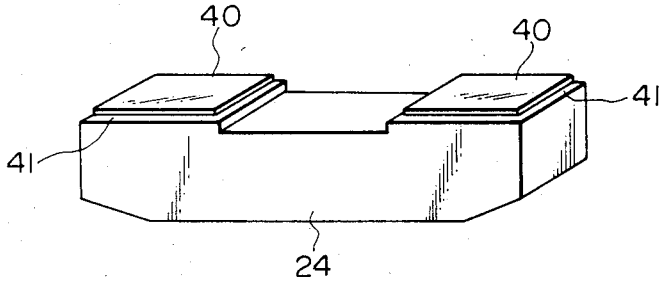
FIG. 6 is a perspective view showing the moving-iron core with the thin non-magnetic plates disposed thereon.

In FIGS. 4–6, numeral 24 designates a movable-iron core of an "I" shaped lamination composed of ferromagnetic blocks or steel sheets. The movable-iron core has contacting electrode surfaces 22 on both sides thereof, respectively, and both contacting electrode surfaces confront a fixed-iron core designated by numeral 28. On the contacting electrode surfaces 22, a thin non-magnetic plate 40 is soldered with a melt type adhesive 41. In this case, in order to fix the thin non-magnetic plate 40 to the contacting electrode surfaces 22, first, a cladding plate 50 having a thin non-magnetic plate 40, on one surface of which a melt-type adhesive such as an oxygen-free copper or silver solder is uniformly disposed is provided as shown in FIG. 5. Subsequently, this cladding plate is cut into desired dimensions and the cut cladding plate is put on the contacting electrode surfaces 22 such that the melt-type adhesive 41 confronts the contacting electrode surfaces as shown in FIG. 6. The plate may have a thickness in the range of 0.08 to 0.2 mm, as an example.

Successively, the moving-iron core with the cladding plate thereon is heated in a furnace in a vacuum or in a reducing atmosphere at a temperature ranging from about 850° to 1110° C., or is heated by high-frequency heating of 25 to 400 KHz at 1110° C., so that the melt-type adhesive 41 is melted. Thereafter, it is cooled down to about 700° to 900° C., resulting in hard soldering of the thin non-magnetic plates 40 having a desired thickness in the range of 0.08 to 0.2 mm to the contacting electrode surfaces 22.

As mentioned above, according to one embodiment of the invention, the attraction between the moving-iron and the fixed-iron cores by remanence is prevented by the presence of the non-magnetic plates disposed on the contacting electrode surfaces.

In the embodiment, because the thin non-magnetic plates having the melt type adhesive formed on one surface thereof are thermally welded to the contacting electrode surfaces, fixing between the non-magnetic plate and the contacting electrode surface is readily achieved and is hard, and the surfaces have a high shock strength. Further, the thickness of the non-magnetic plate influencing the magnetic characteristic of the electromagnet is kept at a desired contact value by controlling the thickness of the thin non-magnetic plate. Moreover, the thickness of the melt-type adhesive formed on the non-magnetic plate can be very thin. Therefore, after welding, the surface of the thin non-magnetic plate and the completed product is smooth. Thus, a polishing process is not subsequently required. Furthermore, flux used in a conventional soldering process is not required because of the use of the melt-type adhesive.

In the above embodiment, the thin non-magnetic plates were thermally welded on the contacting electrode surfaces 22 of the moving-iron core 24. However, it is possible to thermally weld thin non-magnetic plates onto the contacting electrode surfaces of the fixed-iron core, or both the moving-iron core and the fixed-iron core. Also, it is possible for the iron core to assume any desired shape.

What is claimed is:

1. In an electromagnet in which an attractive force is generated between a moving and a fixed-iron core by a d.c. current or rectified a.c. current, the improvement comprising a melt-type adhesive layer of a thermally-melting adhesive composed of an oxygen-free copper or silver solder provided on at least one contacting electrode surface of the moving-iron core and the fixed-iron core, and a thin non-magnetic plate for preventing attraction between said cores due to remanence fixed through said melt-type adhesive layer onto said contacting electrode surface.

2. An electromagnet according to claim 1, wherein at least one of said moving-iron core and said fixed-iron core is composed of laminated steel sheets.

3. An electromagnet accoridng to claim 1, wherein said melt-type adhesive layer and said thin non-magnetic plate are fixed to each other prior to fixing to said contacting electrode surface.

4. An electromagnet according to claim 1, said thin non-magnetic plate having a thickness of 0.08–0.2 mm.

5. An electromagnet according to claim 1, said melt-type adhesive layer being thin compared to said plate.

6. A method of producing an electromagnet of the type wherein a movable-iron core confronting a fixed-iron core is attracted to the fixed-iron core by magnetic flux due to a current flow through a coil wound around the fixed-iron core, comprising forming a thin non-magnetic plate having a melt-type adhesive composed of an oxygen-free copper or silver solder on one surface thereof, and thermally-melting said adhesive to fix said plate on at least one contacting electrode surface of said movable-iron core and said fixed-iron core.

7. An electromagnet as claimed in claim 1, said non-magnetic plate being adhesively bonded to contacting surfaces of both said fixed and moving iron cores.

8. A method as claimed in claim 6, wherein said melt-type adhesive is formed on said plate and is cut to desired dimensions prior to placement of said plate on said contacting surface.

9. A method as claimed in claim 6, said thermal melting step being conducted in a vacuum or reducing atmosphere.

* * * * *